US008360019B2

(12) United States Patent
Scuderi et al.

(10) Patent No.: US 8,360,019 B2
(45) Date of Patent: Jan. 29, 2013

(54) PRESSURE BALANCED ENGINE VALVES

(75) Inventors: Stephen P. Scuderi, Westfield, MA (US); Riccardo Meldolesi, Hove (GB)

(73) Assignee: Scuderi Group, LLC, West Springfield, MA (US)

( * ) Notice: Subject to any disclaimer, the term of this patent is extended or adjusted under 35 U.S.C. 154(b) by 25 days.

(21) Appl. No.: 13/234,258

(22) Filed: Sep. 16, 2011

(65) Prior Publication Data

US 2012/0017860 A1 Jan. 26, 2012

Related U.S. Application Data

(63) Continuation of application No. 12/218,757, filed on Jul. 17, 2008, now abandoned.

(60) Provisional application No. 60/964,525, filed on Aug. 13, 2007.

(51) Int. Cl.
*F01L 3/20* (2006.01)

(52) U.S. Cl. ..... 123/90.16; 123/90.32; 123/188.2; 123/70 R

(58) Field of Classification Search ..... 123/90.16, 123/90.32, 70 R, 188.1–188.5
See application file for complete search history.

(56) References Cited

U.S. PATENT DOCUMENTS

| | | | | |
|---|---|---|---|---|
| 2,342,003 | A * | 2/1944 | Meyer | 123/90.14 |
| 3,601,157 | A | 8/1971 | Milleville et al. | |
| 3,888,280 | A | 6/1975 | Tartaglia | |
| 3,949,964 | A | 4/1976 | Freeman | |
| 4,493,473 | A | 1/1985 | Rexer | |
| 4,858,956 | A | 8/1989 | Taxon | |
| 4,930,464 | A | 6/1990 | Letsche | |
| 5,522,358 | A | 6/1996 | Clarke | |
| 5,572,961 | A | 11/1996 | Schechter et al. | |
| 5,988,124 | A | 11/1999 | Duesmann | |
| 6,178,956 | B1 | 1/2001 | Steinmann et al. | |
| 6,230,742 | B1 | 5/2001 | Bircann | |
| 6,883,775 | B2 | 4/2005 | Coney et al. | |
| 6,899,061 | B1 | 5/2005 | Loth | |
| 6,952,923 | B2 | 10/2005 | Branyon et al. | |

(Continued)

FOREIGN PATENT DOCUMENTS

| | | |
|---|---|---|
| GB | 2250801 | 6/1992 |
| GB | 2340881 | 3/2000 |

(Continued)

OTHER PUBLICATIONS

Kolbenschmidt Pierburg Group "Exhaust Gas Recirculation" Pierburg GmbH Neuss, Germany www.kolbenschmidt-pierburg.com.

*Primary Examiner* — Noah Kamen
*Assistant Examiner* — Grant Moubry
(74) *Attorney, Agent, or Firm* — Fildes & Outland, P.C.

(57) ABSTRACT

A split-cycle engine includes a crankshaft rotatable about a crankshaft axis. A compression piston is slidably received within a compression cylinder and operatively connected to the crankshaft such that the compression piston reciprocates through intake and compression strokes during a single rotation of the crankshaft. An expansion piston is slidably received within an expansion cylinder and operatively connected to the crankshaft such that the expansion piston reciprocates through expansion and exhaust strokes during a single rotation of the crankshaft. A crossover passage interconnects the expansion and compression cylinders. The crossover passage includes crossover compression (XovrC) and crossover expansion (XovrE) valves defining a pressure chamber therebetween. At least one of the XovrC and XovrE valves is a balanced valve. A fluid pressure balancer biases the valve for balancing fluid pressures acting against the valve in both opening and closing directions, reducing the forces required in actuating the valve.

25 Claims, 10 Drawing Sheets

U.S. PATENT DOCUMENTS

| | | | | |
|---|---|---|---|---|
| 7,370,630 | B2 * | 5/2008 | Turner et al. | 123/299 |
| 8,079,339 | B2 * | 12/2011 | Smith | 123/90.65 |
| 2004/0148932 | A1 | 8/2004 | Larson | |
| 2005/0132987 | A1 | 6/2005 | Chang | |
| 2006/0207257 | A1 | 9/2006 | Turner et al. | |
| 2008/0251041 | A1 | 10/2008 | Lou | |

FOREIGN PATENT DOCUMENTS

| | | |
|---|---|---|
| JP | 40-10860 | 4/1965 |
| JP | 10-274105 | 10/1998 |
| JP | 2004-293695 | 10/2004 |

* cited by examiner

Closed
Open
Open
Closed
V1
V2
10
12
14
16
18
20
22
24
26
28
30
32
34
35
36
38
40
42
44
46
48
50
52
54
56
58
60
61
62

TDC
V1 Closed
V2 Open
V1 Open
V2 Closed
V1 Open
V2 Closed
78
32
40
84
83
80
86
100
102
92
94
90
88
106
82
24
22
98
96
14

128
32
130
132
135
Closed
V1
100
102
V2
Open
Closed
94
96
98
24
133
129
20
14
131
136
137
134
139
V1
Open
TDC 138
32
140
142
P2
Blocked
P1
Blocked
94
P3
Open
122
144
120
124
141
118
24

138
140
142
145
P2
Open
P3
Blocked
122
144
120
124
143
118
P1
Open
TDC 138
140
142
P2
Blocked
P3
Open
122
144
120
124
146
147
118
P1
Blocked
24

PRESSURE BALANCED ENGINE VALVES

CROSS REFERENCE TO RELATED APPLICATION

This application is a continuation of U.S. patent application Ser. No. 12/218,757 filed Jul. 17, 2008 which claims the benefit of U.S. Provisional Patent Application No. 60/964,525 filed Aug. 13, 2007.

TECHNICAL FIELD

This invention relates to pressure balanced valves for engines and particularly, though not exclusively, for use in split-cycle engines between the crossover passages and the expansion cylinders.

BACKGROUND OF THE INVENTION

The term split-cycle engine as used in the present application may not have yet received a fixed meaning commonly known to those skilled in the engine art. Accordingly, for purposes of clarity, the following definition is offered for the term "split-cycle engine" as may be applied to engines disclosed in the prior art and as referred to in the present application.

A split-cycle engine as referred to herein comprises:

a crankshaft rotatable about a crankshaft axis;

an expansion (power) piston slidably received within an expansion cylinder and operatively connected to the crankshaft such that the expansion piston reciprocates through an expansion stroke and an exhaust stroke during a single rotation of the crankshaft;

a compression piston slidably received within a compression cylinder and operatively connected to the crankshaft such that the compression piston reciprocates through an intake stroke and a compression stroke during a single rotation of the crankshaft; and a crossover passage interconnecting the expansion and compression cylinders, the crossover passage including a crossover compression (XovrC) valve and a crossover expansion (XovrE) valve defining a pressure chamber therebetween.

Referring to the prior art, FIG. 1 shows a split-cycle engine 1 having separate compression 2 and expansion 3 (combustion) cylinders connected by a pressurized crossover passage 4. Another example is disclosed in U.S. Pat. No. 6,543,225 to Scuderi, filed on Jul. 20, 2001 and assigned to the assignee of the present invention, which is herein incorporated by reference in its entirety (the '225 Pat.). FIG. 1 (as well as the '225 Pat.) illustrates inwardly opening poppet valves for the compression cylinder inlet valve 5, the XovrE valve 6 and the exhaust valve 7. The XovrC valve 8 is illustrated as a check valve but could be of any other suitable type, including an inwardly opening poppet valve similar to the other valves that move towards the piston when opening.

SUMMARY OF THE INVENTION

The present invention provides various embodiments of outwardly opening pressure balanced valves that may be used in one or more locations of the split-cycle engine cylinders such as for the XovrC and XovrE valves, as well as for other uses. Outwardly opening valves move away from the piston and/or the cylinder when opening. In a split-cycle engine, they may assist in maximizing the compression and expansion ratios by reducing piston to head clearance volumes. In selected embodiments, the pressure balanced valves provide means for reducing the forces required in actuating the valves, particularly the cracking pressure and force to be overcome upon initial opening of the valve, when the crossover passage pressures are high and the compression or expansion cylinder pressures are low.

In accordance with the present invention, a split-cycle engine includes a crankshaft rotatable about a crankshaft axis. A compression piston is slidably received within a compression cylinder and operatively connected to the crankshaft such that the compression piston reciprocates through an intake stroke and a compression stroke during a single rotation of the crankshaft. An expansion piston is slidably received within an expansion cylinder and operatively connected to the crankshaft such that the expansion piston reciprocates through an expansion stroke and an exhaust stroke during a single rotation of the crankshaft. A crossover passage interconnects the expansion and compression cylinders. The crossover passage includes a crossover compression (XovrC) valve and a crossover expansion (XovrE) valve defining a pressure chamber therebetween. At least one of the XovrC valve and the XovrE valve is a balanced valve. A fluid pressure balancer biases the valve for balancing fluid pressures acting against the valve in both opening and closing directions, reducing the forces required in actuating the valve.

In the following disclosed exemplary embodiments, the invention includes outwardly opening XovrE valves that control the timing of charge air and/or fuel flow from a crossover passage into an expansion cylinder of a split-cycle engine.

Referring to FIGS. 2-3, a first exemplary embodiment includes a spring seated poppet valve, having a disc shaped poppet head mounted on an end of a valve stem, which is actuated by a cam and rocker mechanism. The valve head has upper and lower surfaces (faces). The upper surface may also be referred to as an inner surface because it faces into the crossover passage, and the lower surface may also be referred to as an outer surface because it faces away from and is disposed outside of the crossover passage. A balance piston is also mounted on a medial section of the stem of the poppet valve to form a poppet valve assembly. The balance piston is reciprocable in an enclosed balance chamber controlled by timed valves to allow entry of crossover passage pressure into the balance chamber beneath the balance piston to balance crossover passage pressure against the upper surface (face) of the poppet valve head prior to valve opening. After opening, the balance chamber is cut off from the crossover passage and the balance pressure is exhausted to atmosphere. The poppet valve is then balanced by equal pressures on both sides of the head while the valve is open.

Referring to FIGS. 4-5, a second exemplary embodiment is similar to the first except that a relocated air spring is substituted for the coil spring of the first embodiment. However, other types of springs or seating devices may be employed in variations of these embodiments if desired.

Referring to FIGS. 6-8, a third embodiment includes a spring seated piston valve (piston valve assembly) having a cylindrical shaped piston head mounted on an end of a valve stem, which is actuated by a cam and rocker mechanism. The piston head is received in a cylinder recess, which forms a balance chamber between the head and the end of the recess. The piston head replaces both the poppet valve head and the balance piston of the first embodiment. Control valves vent recess pressure before opening. In direct contrast to the poppet head of the poppet valve, the piston head is not subject to excessive cracking force upon initially being opened because the crossover passage pressure is applied only radially around the uniform cylindrical body of the piston head. After opening, the control valves connect crossover passage pressure with the balance chamber in order to balance the crossover passage pressure acting on the lower face of the piston head.

Referring to FIGS. 9-11, a fourth embodiment varies from the third embodiment in the use of alternative balanced piston valve actuators, such as electric, hydraulic pneumatic or mechanical. Also, control ports in the piston valve head and the engine substitute for control valves in controlling venting and admission of crossover passage pressure to the balance chamber.

Referring to FIGS. 12-14, in a fifth embodiment, a balance piston and poppet valve head are substituted for the piston head of the third embodiment. Control valves vent the balance chamber above the balance piston in order to equalize crossover passage pressure acting on both the lower surface of the balance piston and the upper surface of the poppet valve head when the poppet valve is closed or beginning to open. The control valves open the balance chamber to the crossover passage to balance crossover passage pressure acting on the lower surface of the poppet valve head when the poppet valve is fully open.

Referring to FIGS. 15-17, in a sixth embodiment, a balance piston and poppet valve head on a valve stem are substituted for the piston head of the fourth embodiment. Ports in the balance piston and engine work in the same manner as those in the fourth embodiment. While a mechanical cam, rocker arm and spring actuating mechanism is shown, any other suitable actuating mechanism may be substituted.

Referring to FIGS. 18-22, a seventh embodiment discloses several variations which could use either a poppet valve assembly (a poppet valve having a poppet head and stem, which is combined with a balance piston) or a piston valve, however only poppet valve assemblies are illustrated. The variations all include a common feature of a balance port disposed in the engine, which provides fluid communication between the combustion chamber of the expansion cylinder and a balance chamber located above the balance piston.

Referring to FIG. 18, in a first variation the balance port is open at all times. The poppet valve assembly remains balanced in either the open or closed position. Any suitable form of balance valve actuation may be utilized.

Referring to FIG. 19, in a second variation, the balance port includes a control valve, which may be closed during combustion, to prevent gas flow into the balance chamber during combustion.

Referring to FIGS. 20-22, in a third variation, a first balance port is disposed between the crossover passage and the balance chamber. A second balance port, similar to those of the first and second variations, is disposed between the combustion (expansion) chamber and the balance chamber. Control valves close the first balance port and open the second balance port during the engine piston exhaust stroke and through initial opening (cracking) of the engine valve. At or near top dead center and during the combustion and expansion stroke, the control valves open the first balance port and close the second balance port.

Thus, during the engine exhaust stroke and when the poppet valve is cracking open, the poppet valve assembly is balanced by crossover passage pressure on the inner faces of the valve head and balance piston and by exhaust pressure on their outer faces, so that opening of the poppet valve is not impeded by an unbalanced high cracking pressure. When the poppet valve is fully open, crossover passage pressure communicates with inner and outer faces of both the balance piston and the valve head, thereby fully pressure balancing the valve assembly. When the poppet valve is closed on the expansion stroke, crossover passage pressure in the balance chamber assists in holding the poppet valve closed during combustion. Although mechanical valve actuation is illustrated, any suitable form of valve actuation may be utilized.

Referring to FIG. 23, in an eighth embodiment a balance port is integrally incorporated into the poppet valve assembly itself, as opposed to the seventh embodiment where the balance port is separately incorporated into the engine. Specifically, the balance port extends from the expansion (combustion) chamber through the center of the valve head and axially into the valve stem. The port continues beyond the crossover passage and is connected with the balance chamber by lateral openings in the valve stem. Thus, the balance port tends to equalize the balance chamber and expansion chamber pressures at all times. Though the eighth embodiment only illustrates a poppet valve assembly, a piston valve assembly may also be utilized.

These and other features and advantages of the invention will be more fully understood from the following detailed description of the invention taken together with the accompanying drawings.

DETAILED DESCRIPTION OF THE INVENTION

Figure 1:
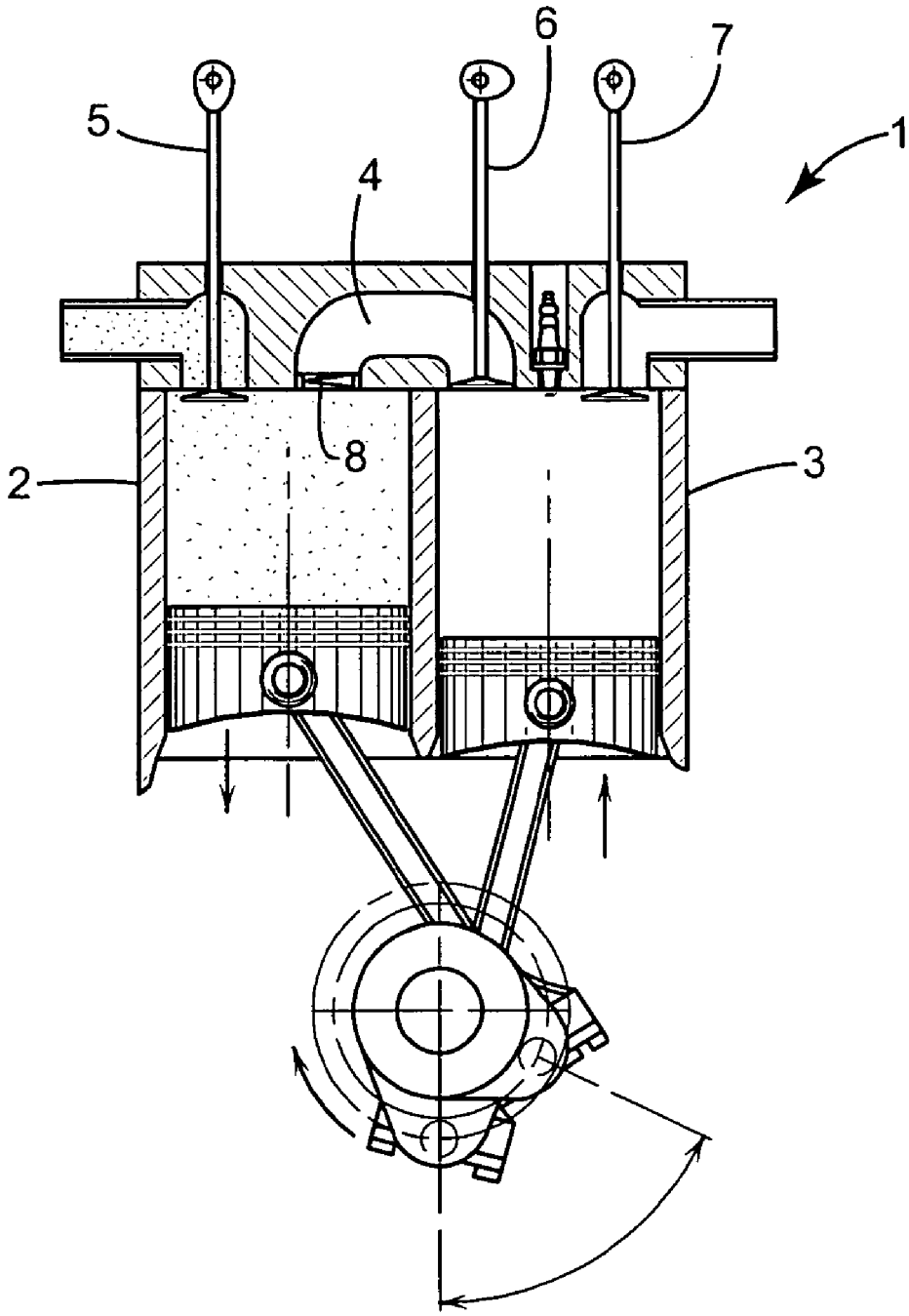
FIG. 1 Prior Art
FIG. 1 is a schematic cross-sectional view of a prior art split-cycle engine.
Figures 2, 3:
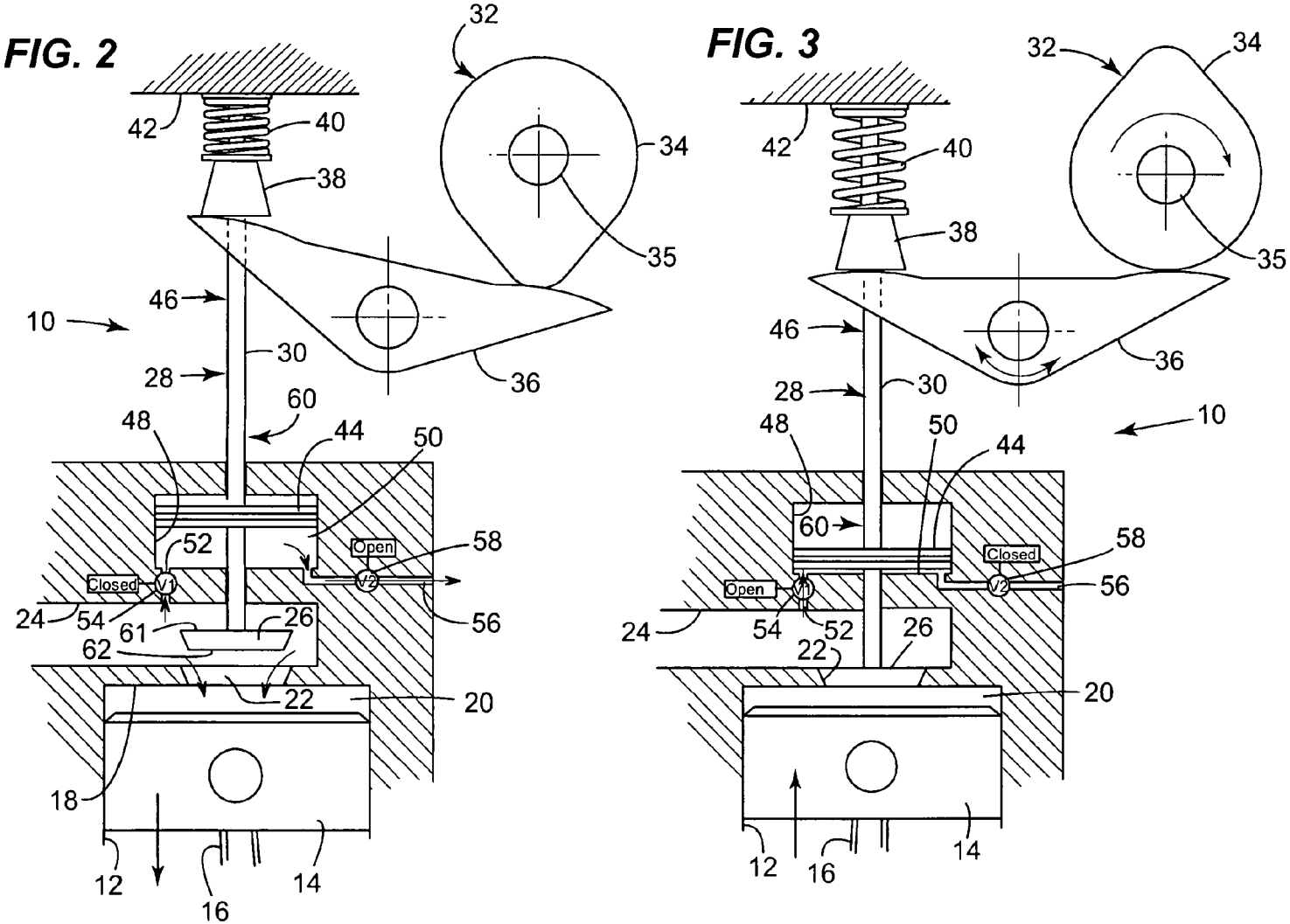
FIGS. 2 and 3 are schematic cross-sectional views of a first exemplary embodiment of the invention with a balanced poppet valve assembly, which is shown respectively in open and closed operating positions.

Referring first to FIGS. 2 and 3, numeral 10 generally indicates a first embodiment of a pertinent portion of a split-cycle engine of a type shown, for example, in the U.S. Pat. No. 6,542,225 previously noted. The exemplary engine 10 is shown schematically and not limited thereby as to general construction. Like reference numerals indicate like or similar components throughout the various embodiments.

Engine 10 includes a combustion (expansion) cylinder 12 in which a power (expansion) piston 14 and connecting rod 16 are reciprocably connected to an output member, such as a crankshaft, not shown. A variable volume between the piston 14 and the closed end 18 of the cylinder 12 forms a combustion (expansion) chamber 20. The combustion chamber communicates through an opening in a valve seat 22 with a crossover passage 24, which stores and carries pressurized air from the compressor cylinder, not shown, for delivery to the combustion chamber 20. The crossover passage may be kept at a variable but elevated pressure.

In accordance with the invention, the valve seat 22 may be angled outwardly to provide for engagement by a disc shaped poppet head 26 of an outwardly opening poppet valve 28 having a stem 30. The poppet head 26 is reciprocable within the crossover passage 24 and controls access to the combustion chamber 20, cutting off air and/or fuel flow to the combustion chamber 20 when the head 26 is seated on the valve seat 22. The valve head 26 has an upper surface (face) 61 and a lower surface (face) 62. The upper surface 61 may also be referred to as an inner surface because it faces into the crossover passage 24, while the lower surface 62 may also be referred to as an outer surface because it faces away from and is disposed outside of the crossover passage 24.

The poppet valve 28 is actuated by any suitable actuating mechanism 32, mechanical, electrical, hydraulic pneumatic or combination thereof, as desired. The valve actuating mechanism 32 is represented in FIGS. 2 and 3 by a cam 34 carried on a camshaft 35 and driving a pivotable rocker arm 36 that engages an actuator fitting 38 on the valve stem 30. The fitting 38 also acts as a retainer for a valve spring 40 that engages a fixed member 42 of the engine and urges the valve 28 in a closing direction.

A balance piston 44 (e.g., "fluid pressure balancer") is carried on the valve stem 30 between the valve head 26 and the actuator fitting 38. The valve head 26, stem 30 and balance piston 44 may be referred to as a poppet valve assembly 46. The balance piston 44 is reciprocable within an enclosed separate balance cylinder 48 of the engine spaced above the crossover passage 24. The portion of the balance cylinder 48 below the balance piston 44 may be referred to as a balance chamber 50. The balance chamber communicates with the crossover passage 24 by a first balance port 52 controlled by a first control valve 54 (V1), such as a solenoid valve or other suitable valve. A second balance port 56 controlled by a second control valve 58 (V2) communicates the balance chamber 50 with external ambient pressure. The poppet valve assembly 46, actuating mechanism 32 and the associated balance chamber 50, ports 52, 56 and valves 54 (V1) and 58 (V2) may be referred to as the balanced valve apparatus 60.

FIG. 2 of the drawings illustrates the position of the apparatus 60 when the poppet valve assembly 46 is open. The engine power piston 14 is beginning to descend while a pressurized air charge is forced through the valve seat 22 into the combustion chamber 20. Since the valve head 26 is open to crossover passage pressure on both upper 61 and lower 62 faces, the first control valve 54 (V1) is closed and the second control valve 58 (V2) is open, venting the balance chamber 50 to ambient pressure.

FIG. 3 shows the apparatus 60 positions when the poppet valve assembly 46 is closed. Second control valve 58 (V2) is closed and first control valve 54 (V1) is open, supplying crossover passage pressure to the balance chamber 50 so that the crossover pressure on the valve head 26 will be balanced. The opening force applied by the actuating mechanism 12 to (initially) crack open the valve head 26 is thus reduced.

Figure 5:
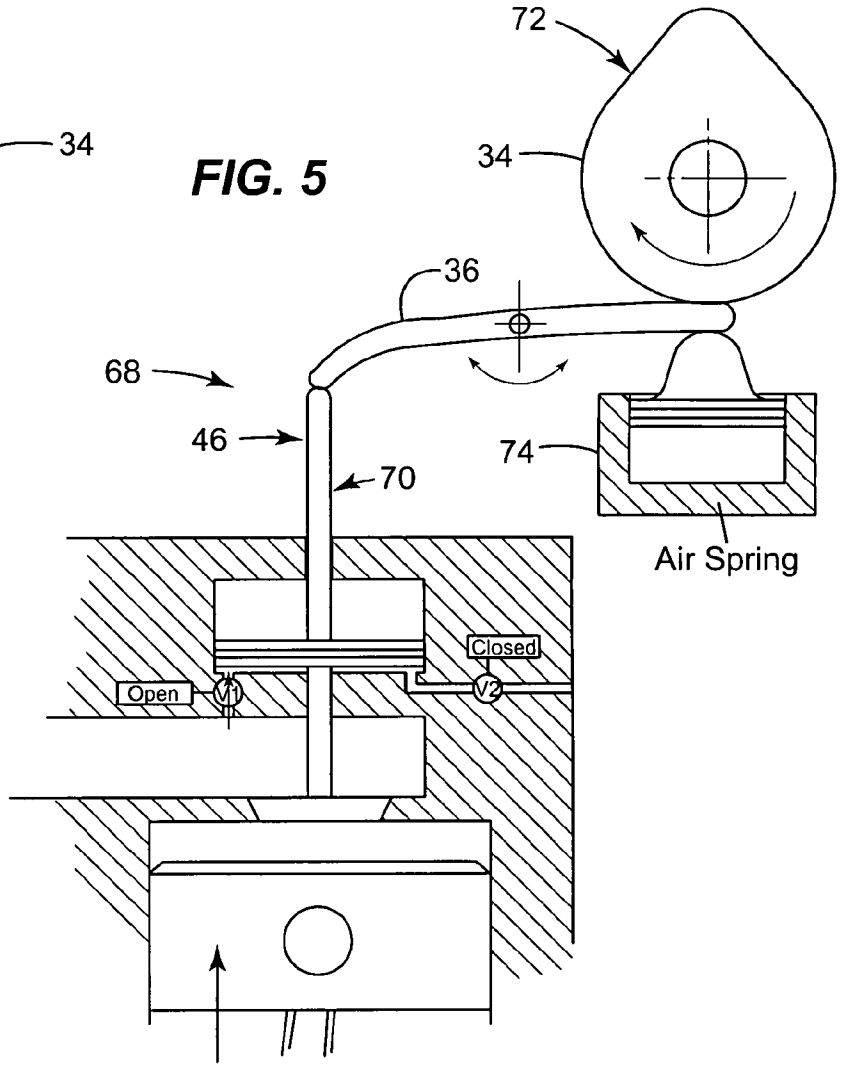
FIGS. 4 and 5 are schematic cross-sectional views similar to FIGS. 2 and 3 but showing a second exemplary embodiment of the invention with an air spring and balanced poppet valve assembly, which is shown respectively in similar operating positions to the first embodiment.
Figure 4:
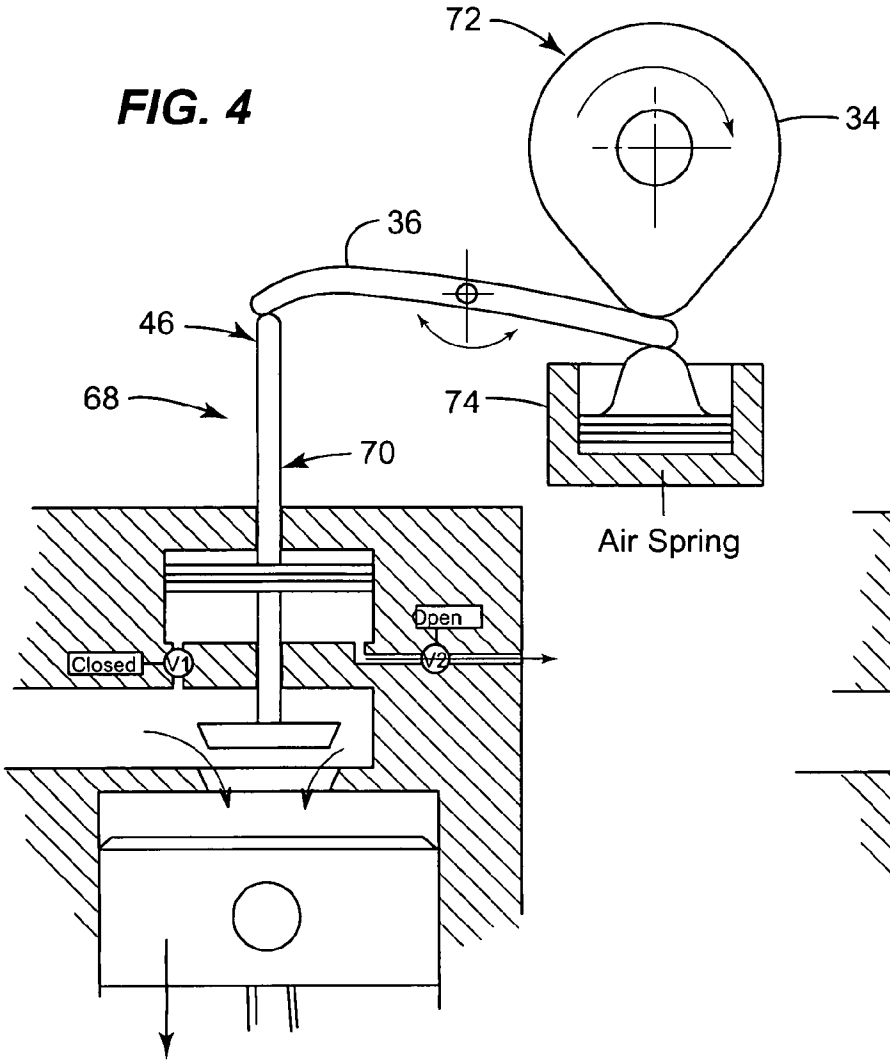

FIGS. 4 and 5 of the drawings illustrate a second embodiment of engine 68 and balanced valve apparatus 70 similar to the first embodiment of FIGS. 2 and 3. The balanced valve apparatus 70 of the second embodiment differs from the balanced valve apparatus 60 of the first embodiment in the substitution of an air spring 74 (within valve actuating mechanism 72) in place of the coil spring 40 shown in FIGS. 2 and 3. The air spring 74 is also relocated to engage the rocker arm 36 directly opposite its engagement with the cam 34, but its function is the same. It should be understood that any other suitable spring or actuating mechanism could be used for operating the balanced valve assembly 46 of the invention if desired. Also, an air spring could be used in place of other springs in any form of mechanical actuating mechanism.

Figures 6, 7, 8:
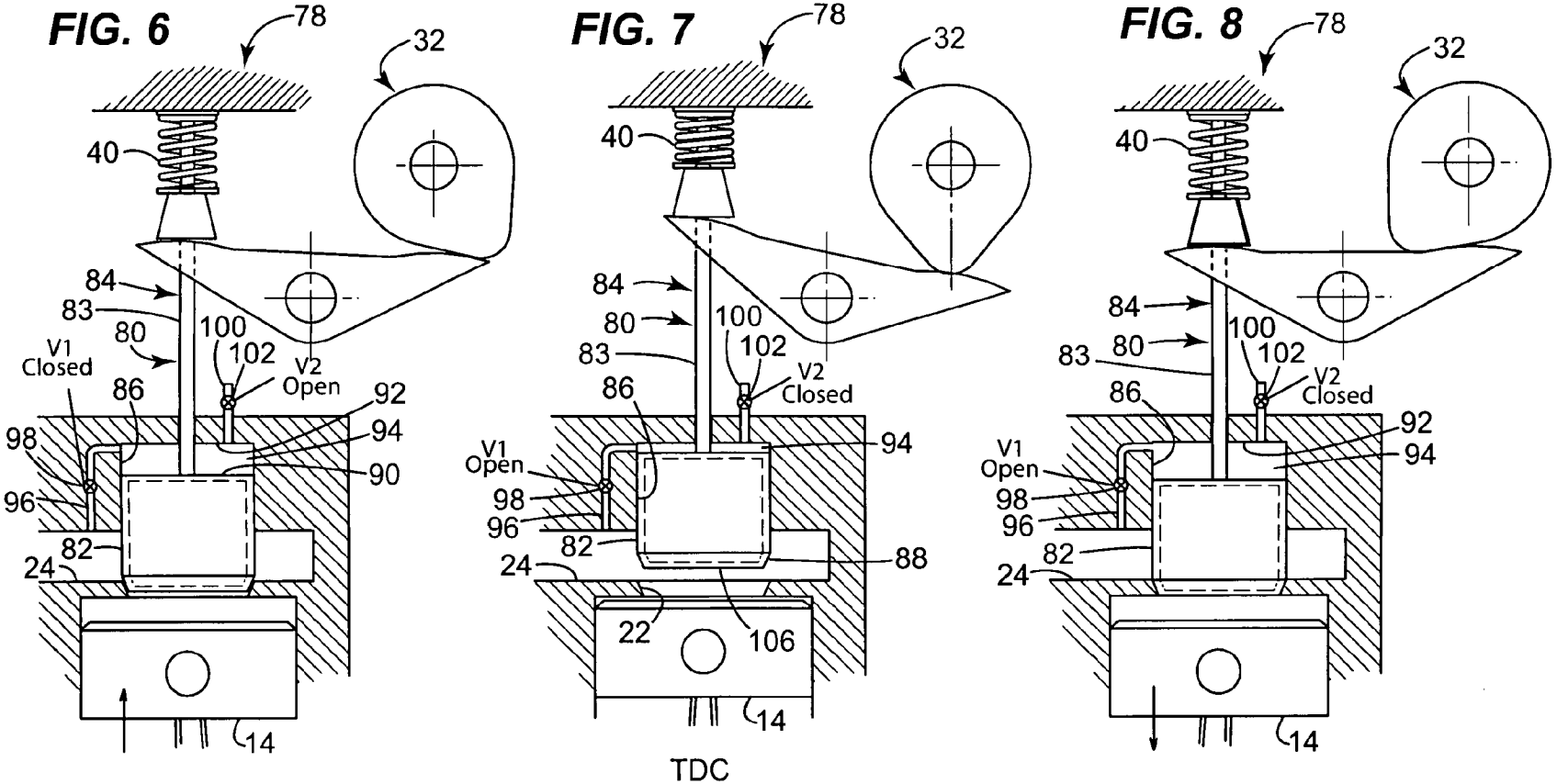
FIGS. 6, 7 and 8 are schematic cross-sectional views showing a third exemplary embodiment of the invention with an alternative balanced cylindrical piston valve, which is shown respectively in initial opening (cracking), fully open and closed positions.

FIGS. 6, 7 and 8 illustrate a third embodiment of engine 78 having a balanced valve apparatus 80. The valve apparatus 80 includes a piston valve (piston valve assembly) 84, having a cylindrical shaped piston head 82 mounted on a stem 83. The piston valve 84 replaces the poppet valve assembly 46 of the first embodiment. The piston valve 84 is shown with the mechanical actuating mechanism 32, but is not limited thereto. The piston valve 84 is reciprocable in a cylindrical recess 86 open to the crossover passage 24 but separated therefrom by the piston head 82.

The piston head 82 may be hollow to minimize its mass. A chamfer 88 on the lower periphery of the piston head 82 is adapted to seat on the valve seat 22. The top (inner face) 90 of the piston head 82 and the end 92 of the recess 86 form a balance chamber 94 (e.g., "fluid pressure balancer"). A first balance port 96 controlled by a first control valve (V1) 98 communicates the balance chamber 94 with the crossover passage 24. A second balance port 100 controlled by a second control valve (V2) 102 communicates the balance chamber with ambient pressure.

In operation, when the engine power piston 14 is ascending during its exhaust stroke and discharging through an exhaust valve, not shown, the piston valve 84 is closed (seated on the valve seat). When the piston valve 84 is seated, the pressure in the crossover passage 24 can act only radially on the cylindrical outer surface of the piston head 82. Since there is no vertical component to the crossover passage 24 pressure acting on the piston head 82, the crossover passage pressure does not contribute to the cracking force that must be overcome upon initial opening of the head.

Also during the power piston's 14 exhaust stroke, valve (V1) 98 is closed and valve (V2) 102 is open. Thus ambient pressure in the balance chamber 94 essentially balances exhaust pressure in the engine combustion chamber 20. Therefore, when the piston valve 84 is cracked open (begins to open), as shown in FIG. 6, the actuating mechanism 32 can open the piston valve 84 by overcoming only the spring 40 seating force.

As shown in FIG. 7, the crossover passage pressure acts against the bottom (outer face) 106 of the piston head 82 when the piston valve 84 is fully open. Thus valve V1 (98) is opened and valve V2 (102) is closed to direct crossover passage pressure to the balance chamber 94. Then the pressure on the piston valve 84 remains balanced until the piston valve is closed by the valve spring 40 as shown in FIG. 8. This continues through combustion and the expansion stroke while crossover passage pressure is maintained in the balance chamber 94, assisting the valve spring 40 to hold the piston valve 84 closed against combustion and expansion pressures.

During the following exhaust stroke, the piston valve 84 is again cracked open as shown in FIG. 6 and the cycle is repeated.

Figure 11:
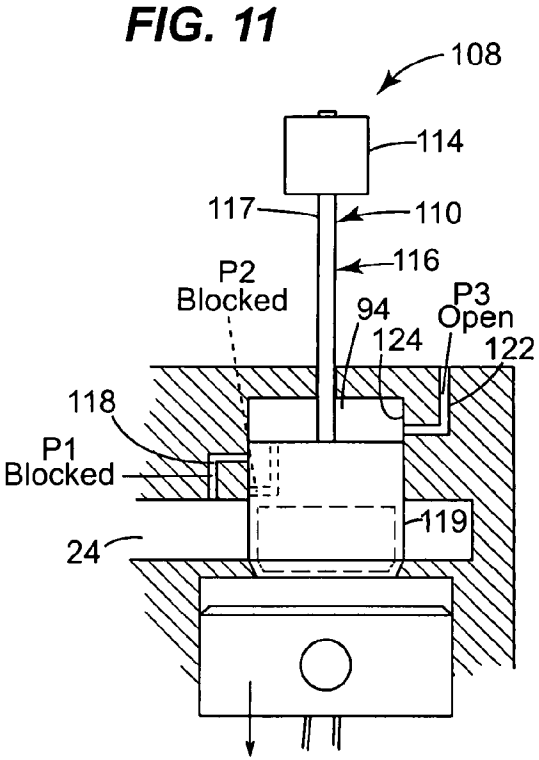
FIGS. 9, 10 and 11 are schematic cross-sectional views showing a fourth exemplary embodiment of the invention with an alternative actuator and a balanced cylindrical piston valve with a control port in the piston head, which is shown respectively in initial opening (cracking), fully open and closed positions.
Figure 10:
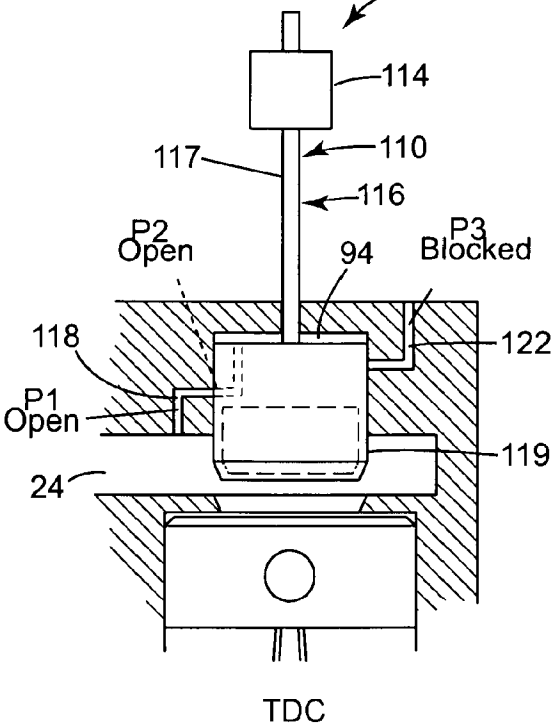
Figure 9:
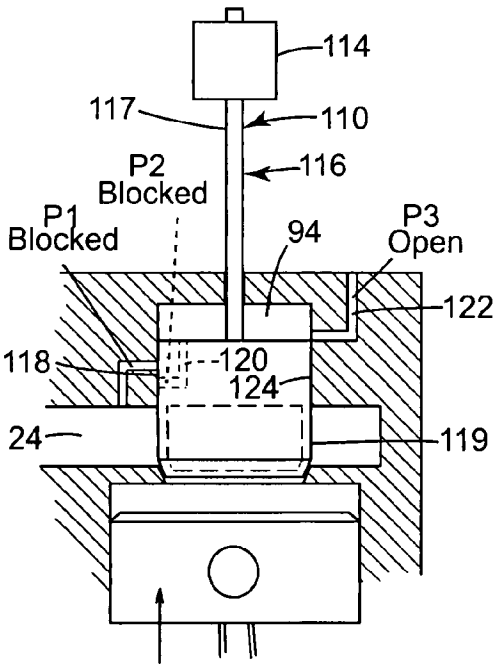

FIGS. 9, 10 and 11 illustrate a fourth embodiment of engine 108 and balanced valve apparatus 110 similar to those of the third embodiment of FIGS. 6, 7 and 8. They differ in that an alternative valve actuating mechanism 114 is shown as representative of any suitable type shown schematically, such as electro-magnetic, pneumatic, hydraulic, mechanical or a combination thereof. A piston valve 116, having a stem 117 and a modified piston head 119, is disposed in a cylindrical recess 124, defining a balance chamber 94. Pressure in the balance chamber 94 is controlled by balance ports 118 (P1), 120 (P2) and 122 (P3).

Ports P1 and P2 are disposed in the engine 108 and piston head 119 respectively, and connect when the piston valve 116 is fully open to communicate crossover passage 24 pressure to the balance chamber 94. At this time port P3, disposed in the engine 108, is blocked by the piston head 119 as shown in FIG. 10, maintaining the balance chamber pressure. When the piston valve is fully closed (FIG. 11) or cracked open (FIG. 9), ports P1 and P2 are misaligned and block air flow from the crossover passage 24 while port P3 is open and vents the balance chamber 94 to ambient pressure. The arrangement of ports P1 and P2 may be varied such that ports P1, P2 connect earlier and disconnect later to have a longer "balanced period."

Figures 12, 13, 14:
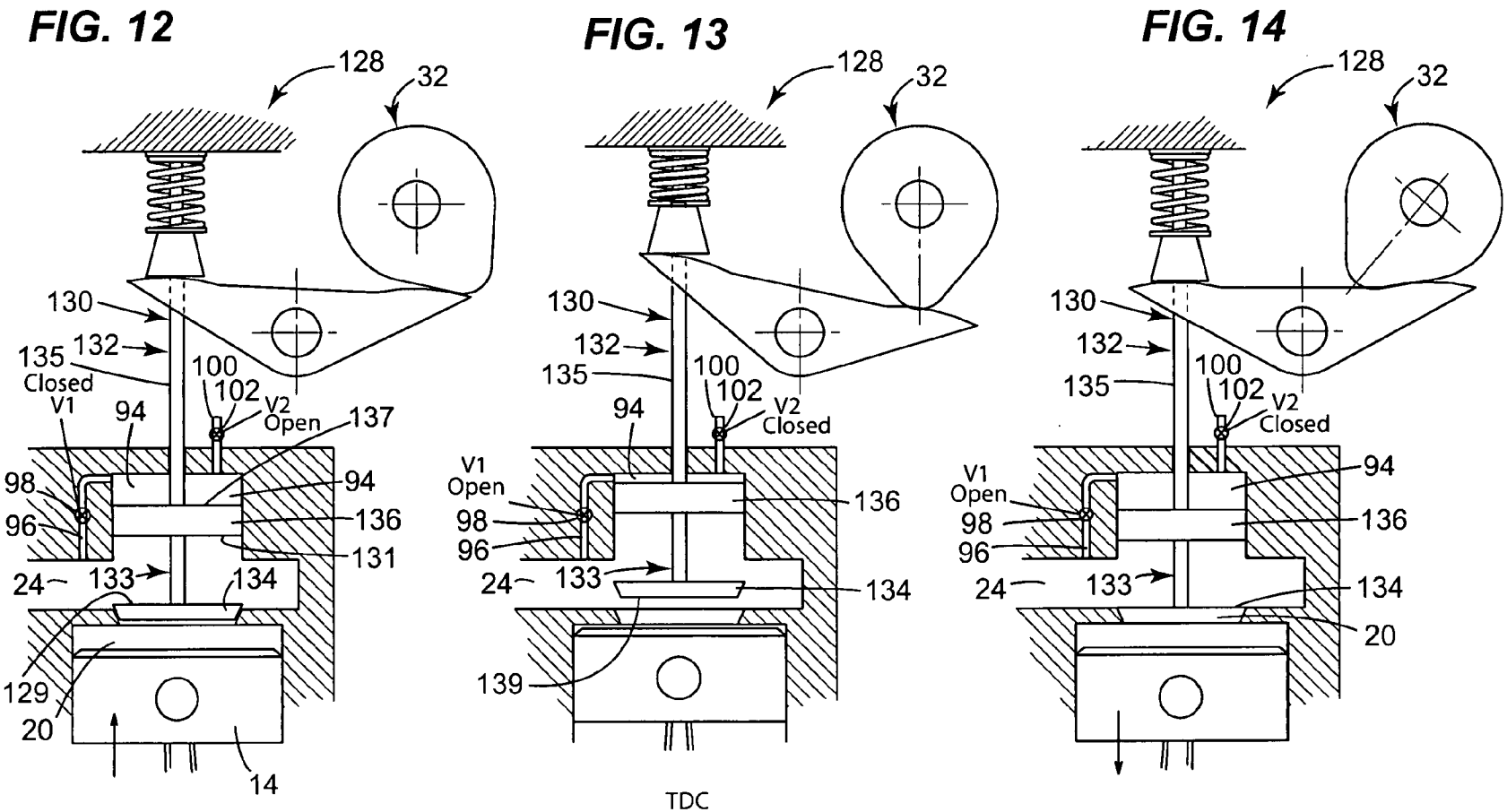
FIGS. 12, 13 and 14 are schematic cross-sectional views showing a fifth exemplary embodiment of the invention including a poppet valve assembly having valved balance ports, the poppet valve assembly being shown respectively in initial opening, fully open and closed positions.

FIGS. 12, 13 and 14 illustrate a fifth embodiment of engine 128 having a balanced valve apparatus 130, which includes a poppet valve assembly 132 opened and closed by valve actuating mechanism 32. The valve actuating mechanism 32 is mechanical, although it is not so limited.

The poppet valve assembly 132 includes a poppet valve 133 having a poppet head 134 disposed on the lower end of a valve stem 135. The poppet valve assembly 132 also includes a balance piston 136 mounted on a medial section of the stem 135 of the poppet valve 133. The balance piston 136 has a lower surface (face) 131 and an upper surface (face) 137. The lower surface 131 may also be referred to as an inner surface because it faces into the crossover passage 24, and the upper surface 137 may also be referred to as an outer surface because it faces away from and is disposed outside of the crossover passage 24.

The balance chamber 94, balance ports 96, 100 and control valves 98, 102 are similar and operate in a like manner as previously mentioned components having the same reference numbers. Accordingly, during the power piston's 14 exhaust stroke, valve (V1) 98 is closed and valve (V2) 102 is open. Thus, ambient pressure in the balance chamber 94 essentially balances exhaust pressure in the engine combustion chamber 20. Additionally, the vertical component of the crossover passage 24 pressure acting downwardly upon the upper surface (inner face) 129 of poppet head 134 is balanced by the same crossover passage pressure acting upwardly upon the lower surface (inner face) 131 of balance piston 136. Therefore, when the poppet valve assembly 132 is cracked open (begins to open), as shown in FIG. 12, the actuating mechanism 32 can open the poppet valve assembly 132 by overcoming only the spring 40 seating force.

As shown in FIG. 13, the crossover passage pressure acts upwardly against the lower surface (outer face) 139 of the poppet head 134 when the poppet valve assembly 132 is fully open. Thus valve V1 (98) is opened and valve V2 (102) is closed to direct crossover passage pressure to the balance chamber 94 and downwardly against the upper surface (outer face) 137 of the balance piston 136. Then the pressure on the poppet valve assembly 132 remains balanced until the poppet valve assembly 132 is fully closed by the valve spring 40 as shown in FIG. 14. This continues through combustion and the expansion stroke while crossover passage pressure is maintained in the balance chamber 94, assisting the valve spring 40 to hold the poppet valve assembly 132 closed against combustion and expansion pressures.

During the following exhaust stroke, the poppet valve assembly 132 is again cracked open as shown in FIG. 12 and the cycle is repeated.

Figures 15, 16, 17:
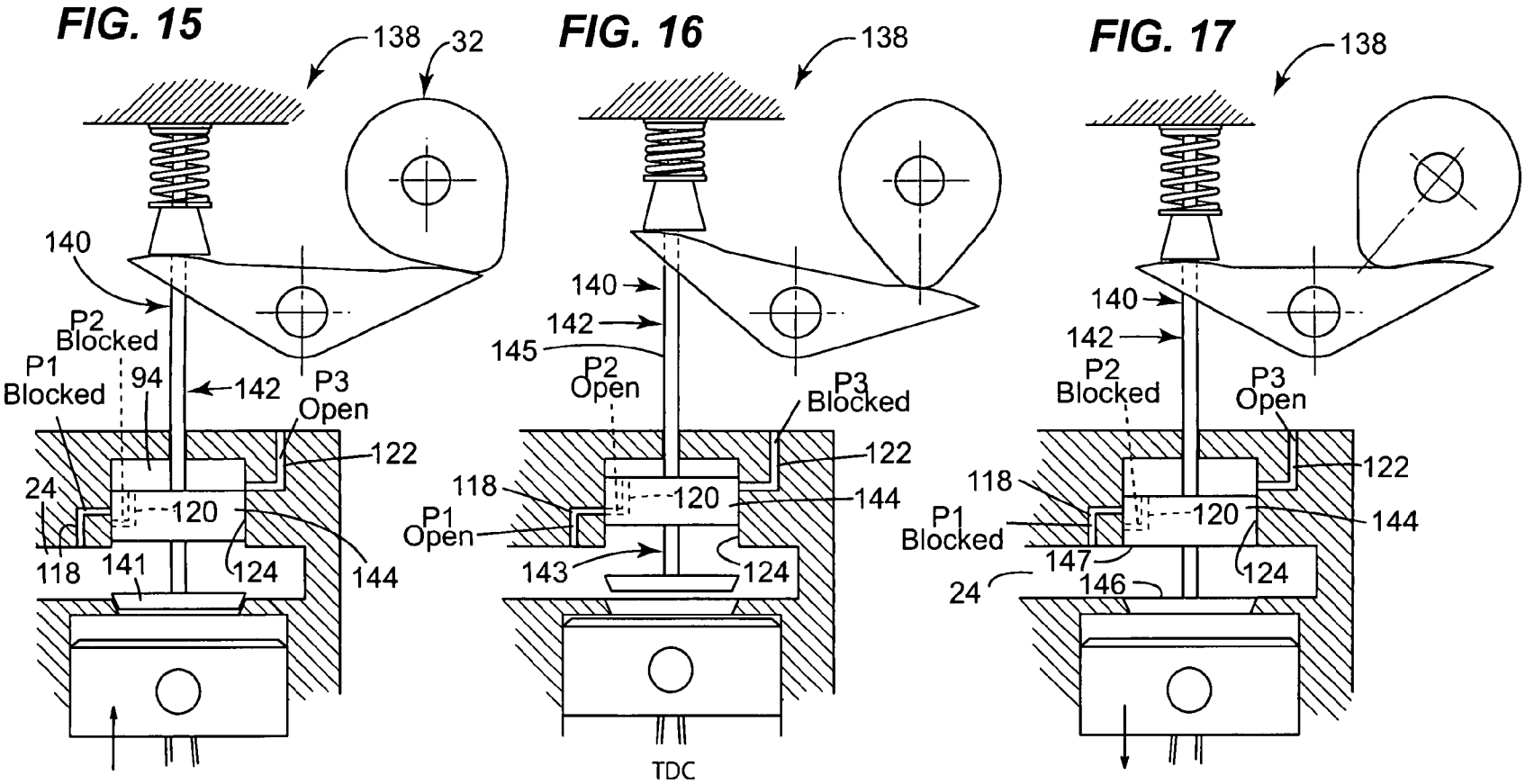
FIGS. 15, 16 and 17 are schematic cross-sectional views showing a sixth exemplary embodiment of the invention including a poppet valve assembly having balance ports in the balance piston of the poppet valve assembly and in the engine, the poppet valve assembly being shown respectively in initial opening, fully open and closed positions.

FIGS. 15, 16 and 17 illustrate a sixth embodiment of engine 138 having a balanced valve apparatus 140, which includes a poppet valve assembly 142 opened and closed by valve actuating mechanism 32. The valve actuating mechanism 32 is mechanical, although it is not so limited.

The poppet valve assembly 142 includes a poppet valve 143 having a poppet head 141 disposed on the lower end of a valve stem 145. The poppet valve assembly 142 also includes a balance piston 144 mounted on a medial section of the stem 145 of the poppet valve 143.

Port 120 (P2) disposed in balance piston 144, as well as ports 118 (P1) and 122 (P3) disposed in the engine 138, are similar and operate in a like manner as previously mentioned components having the same reference numbers. Accordingly, ports P1 and P2 connect when the poppet valve assembly 142 is fully open to communicate crossover passage 24 pressure to the balance chamber 94. At this time port P3, disposed in the engine 138, is blocked by the balance piston 144 as shown in FIG. 16, maintaining the balance chamber pressure. When the poppet valve assembly 142 is fully closed (FIG. 17) or cracked open (FIG. 15), ports P1 and P2 are misaligned and block air flow from the crossover passage 24 while port P3 is open and vents the balance chamber 94 to ambient pressure. At all times, crossover passage pressure is balanced against the inner faces 146 and 147 of the poppet head 141 and balance piston 144 respectively.

Referring to FIGS. 18-22, a seventh embodiment of the invention includes three variations, all of which share a common feature of a balance port 152 disposed in an engine 148, which provides fluid communication between a balance chamber 94 and a combustion chamber 20 of the engine 148. Although all variations show a poppet valve assembly 149, it should be noted that a single piston valve (such as piston valve 84 of the third embodiment) may also be used.

Figure 18:
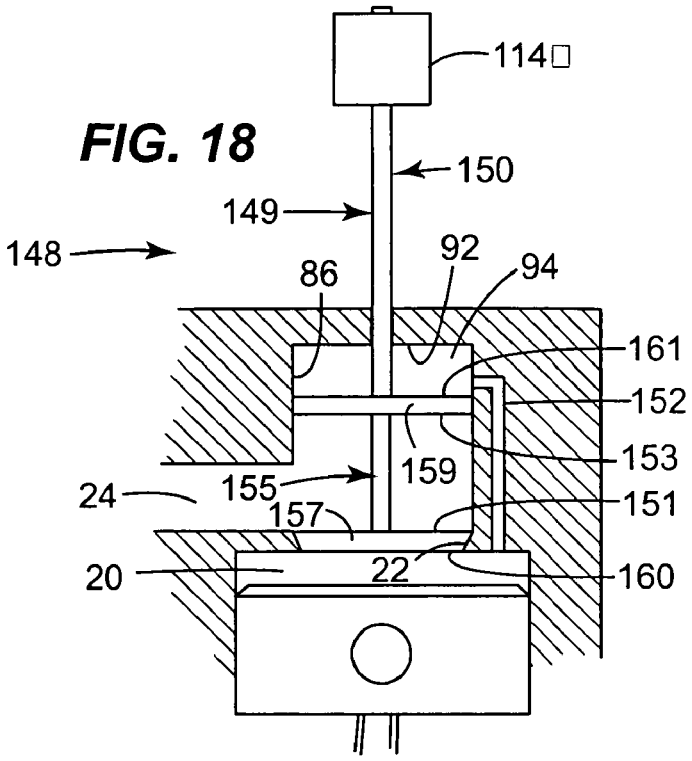
FIG. 18 is a schematic cross-sectional view of a first variation of a seventh exemplary embodiment of the invention wherein the first variation has, in common with the other variations, a poppet valve assembly and a separate balance port connected between a balance chamber and the combustion (expansion) chamber.

FIG. 18 illustrates the first variation in which an engine 148 includes a balanced valve apparatus 150 with a poppet valve assembly 149. The poppet valve assembly 149 includes a poppet valve 155 having a separate poppet head 157 and balance piston 159. The poppet head 157 and balance piston 159 each include inner faces 151 and 153 respectively, both of which are open to the crossover passage 24. When the poppet valve 155 is closed, the valve head 157 is seated on the valve seat 22 separating the crossover passage 24 from the engine combustion chamber 20. The balance piston 159 forms a balance chamber 94 with an end 92 of a cylindrical recess 86.

In the first variation, a balance port 152 within the engine 148 provides fluid communication between the balance chamber 94 and the combustion chamber 20 in the expansion cylinder. Port 152 is always open to balance combustion chamber pressure on both the outer face 160 of poppet head 157 and the outer face 161 of balance piston 159. Additionally, the downward vertical component of the crossover passage 24 pressure against the inner face 151 of poppet head 157 is always balanced against the upward vertical component of the crossover passage pressure against the inner face 153 of balance piston 159.

When the poppet valve 155 is open, the pressures tend to be equal on all faces 151, 153, 160 and 161. The poppet valve 155 is opened and closed by a generic valve actuating mechanism 114.

Figure 19:
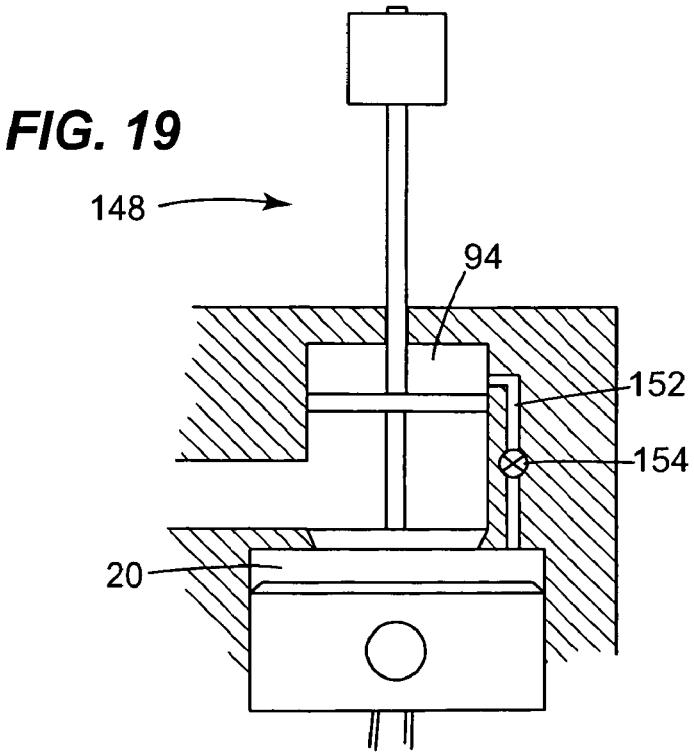
FIG. 19 is a schematic cross-sectional view showing a second variation of the seventh exemplary embodiment of the invention wherein the balance port includes a control valve, which may be closed during combustion and/or expansion in the combustion chamber.

FIG. 19 illustrates the second variation, which includes a control valve 154 in the port 152. The valve 154 may be closed during combustion in the combustion chamber 20 to avoid fouling the chamber with combustion products and to reduce the compression ratio during the combustion process.

Figure 22:
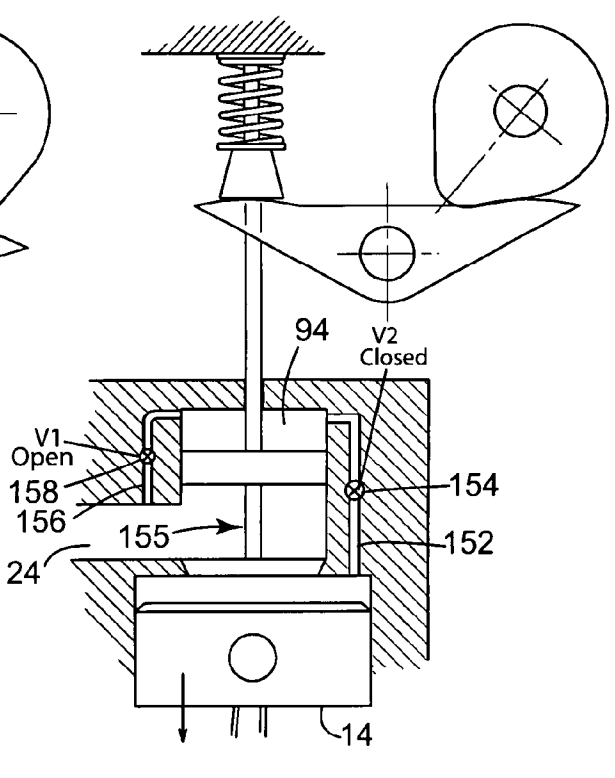
FIGS. 20, 21 and 22 are schematic cross-sectional views showing a third variation of the seventh exemplary embodiment of the invention including a first valved balance port between the crossover passage and the balance chamber and a second valved balance port between the combustion chamber and the balance chamber, the poppet valve assembly being shown respectively in initial opening, fully open and closed positions.
Figure 21:
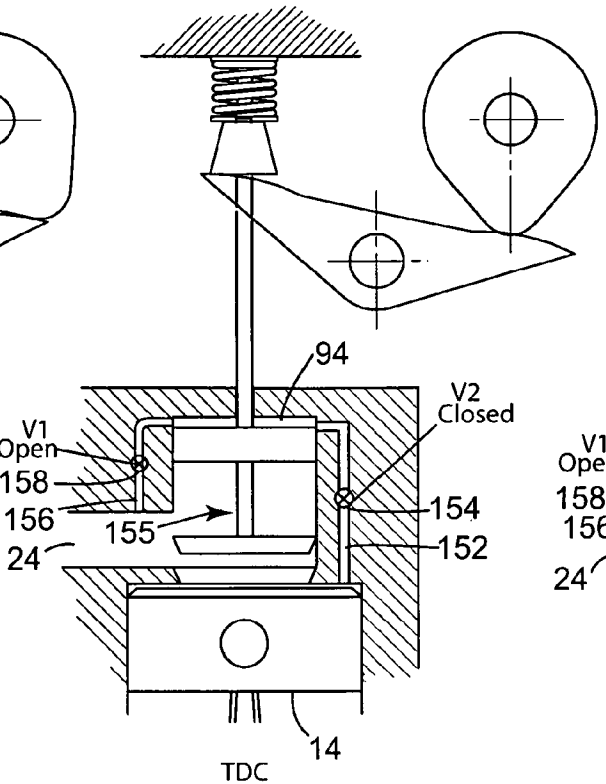
Figure 20:
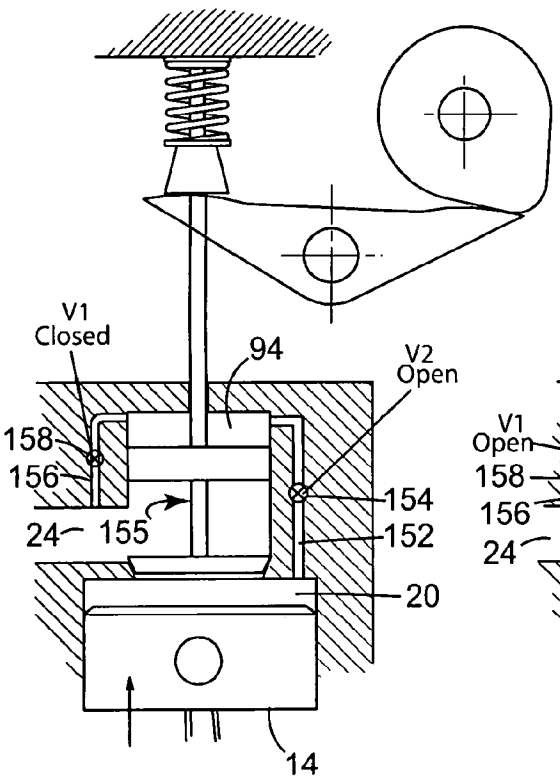

FIGS. 20, 21 and 22 illustrate the third variation in which balance port 152 and control valve 154 are retained and an additional balance port 156, controlled by a another control valve 158 (V1), is added between the crossover passage 24 and the balance chamber 94. The control valve 154 is identified as V2. The valve V1 (158) is closed during the power piston's 14 exhaust stroke and during cracking open (initial opening) of the engine poppet valve 155. However, control valve V1 (158) is open at or near top dead center of the power piston 14 and during the expansion stroke. Valve V2 (154) is open during the exhaust stroke and during poppet valve cracking but closed when the poppet valve 155 is fully open and during the expansion stroke.

The results are like those of the fifth embodiment. The poppet valve 155 is pressure balanced during the power piston's 14 exhaust stroke and during its cracking open (i.e., the beginning of the opening of the poppet valve). During these periods, the pressure in the balance chamber 94 is essentially balanced with the pressure in the engine combustion chamber 20. Additionally, the vertical component of the crossover passage 24 pressure acting downwardly upon the upper surface (inner face) of the poppet head is balanced by the same crossover passage pressure acting upwardly upon the lower surface (inner face) of the balance piston. The valve 155 remains balanced during charging of the combustion chamber 20 with crossover passage 24 pressure. During this period, the crossover passage 24 pressure acts upwardly against the bottom surface (outer face) of the valve head, and the same pressure in the balance chamber 94 acts downwardly against the upper surface (outer face) of the balance piston. The crossover passage 24 pressure remains in the balance chamber 94 through the expansion stroke after the valve 155 has closed to assist in offsetting combustion pressure in the combustion chamber 20.

Figure 23:
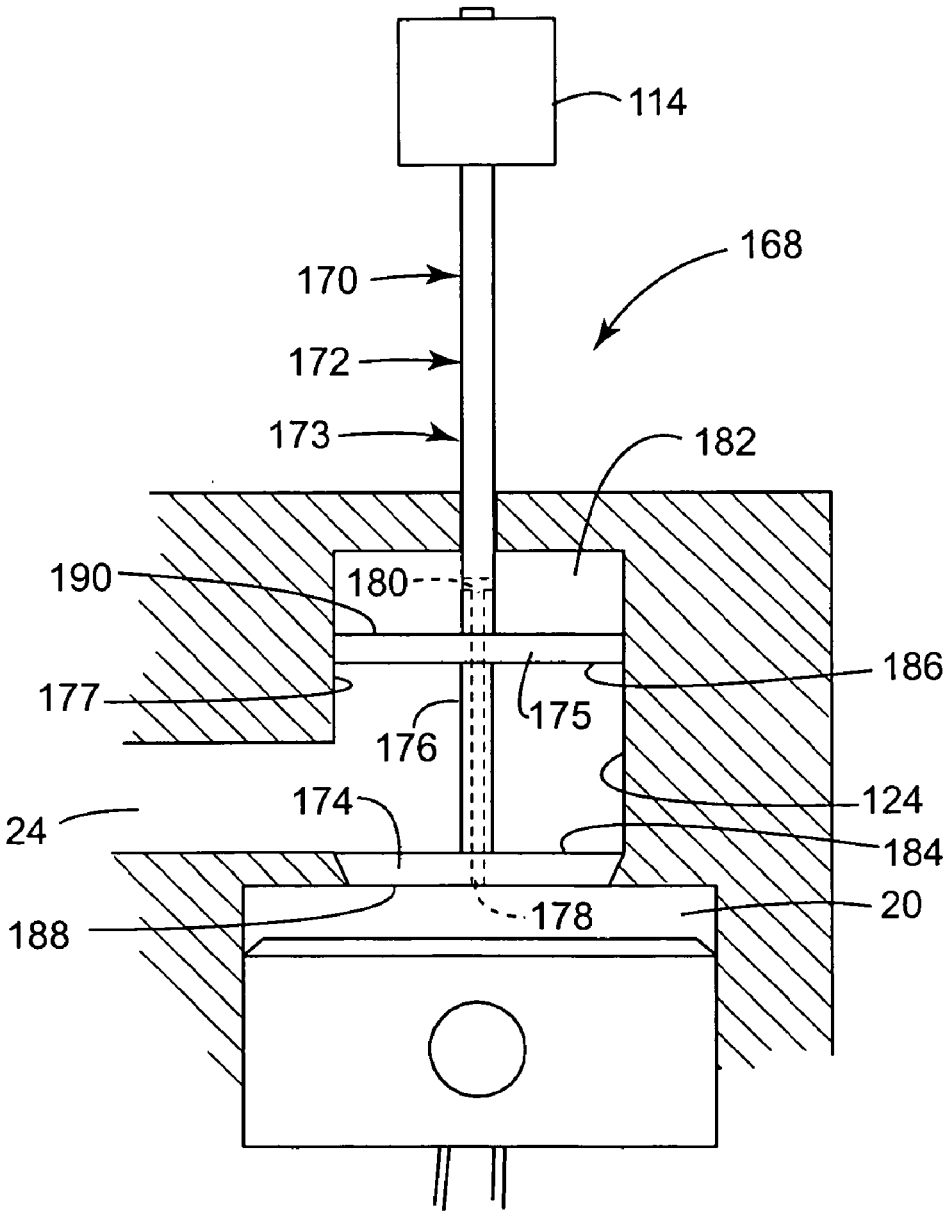
FIG. 23 is a schematic cross-sectional view of an eighth exemplary embodiment of the invention of a poppet valve assembly having an integral balance port which extends axially through the valve stem and head of the poppet valve.

FIG. 23 illustrates the eighth embodiment in which an engine 168 includes a balanced valve apparatus 170 having a poppet valve assembly 172 that is actuated by a generic actuating mechanism 114. For ease of manufacturing, the eighth embodiment includes a balance port 178 integrally incorporated into the poppet valve assembly 172, as opposed to the seventh embodiment where the balance port is separately incorporated into the engine. Although this embodiment shows a poppet valve assembly 172, it should be noted that a single piston valve (similar to piston valve 84) with an internal balance port may also be used.

Poppet valve assembly 172 includes a poppet valve 173 having a generally disc shaped poppet head 174 mounted to a lower end of a valve stem 176. The poppet valve assembly 172 also includes a balance piston 175 mounted to a medial section of the stem 176. The balance piston 175 reciprocates in a cylindrical recess 177 and defines a balance chamber 182 above the balance piston 175.

Poppet valve assembly 172 includes the internal balance port 178, which extends axially from the expansion chamber 20 through the valve head 174 and valve stem 176 above the balance piston 175. Lateral openings 180 extend the internal balance port 178 to provide fluid communication with the balance chamber 182.

Accordingly, pressure in the expansion chamber 20 maintains a pressure balance on the outer faces 188 and 190 of poppet valve head 174 and the balance piston 175 respectively at all times. Additionally, pressure in the crossover passage 24 maintains a pressure balance on the inner faces 184 and 186 of the poppet valve head 174 and the balance piston 175 respectively at all times.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A pressure balancing system for an engine (10), comprising:

an engine piston (14) slidably received within a cylinder (12) and operatively connected to a crankshaft;

an engine valve (28) including a stem (30) and a head (26), the engine valve (28) operable to engage a valve seat (22) and control fluid communication between a passage (24) and the cylinder (12); and a balance piston (44) on the stem (30) of the valve (28) and movable in an enclosed separate balance cylinder (48) that together with the balance piston (44) defines a balance chamber (50), the balance chamber (50) being in fluid communication with the passage (24) via a first balance port (52) controlled by a first control valve (54), and the balance chamber (50) being in fluid communication with a low pressure source via a second balance port (56) controlled by a second control valve (58);

wherein system is configured such that the first control valve (54) is closed and the second control valve (58) is open when the head (26) of the engine valve (28) is disengaged from the valve seat (22), and the first control valve (54) is open and the second control valve (58) is closed when the head (26) of the engine valve (28) is engaged with the valve seat (22).

2. The pressure balancing system of claim 1, wherein the engine valve (28) is configured to open outwardly into the passage (24) and away from the cylinder (12).

3. The pressure balancing system of claim 1, wherein the engine (10) is a split-cycle engine (10), and the passage (24) is the crossover passage (24) of the split-cycle engine (10).

4. The pressure balancing system of claim 1, wherein the low pressure source is external ambient pressure.

5. The pressure balancing system of claim 1, further comprising an actuating mechanism (32) configured to actuate the engine valve (28).

6. A pressure balancing system for an engine (78/128), comprising:

an engine piston (14) slidably received within a cylinder (12) and operatively connected to a crankshaft;

an engine valve (84/133) including a stem (83/135) and a valve piston (82/136), the engine valve (28) operable to engage a valve seat (22) and control fluid communication between a passage (24) and the cylinder (12);

a balance chamber (94) formed by a top (90/137) of the valve piston (82/136) and a recess (86) connected to and extending from the passage (24), the balance chamber (94) being in fluid communication with the passage (24) and a low pressure source;

a first balance port (96), controlled by a first control valve (98), that communicates the balance chamber (94) with the passage (24); and a second balance port (100), controlled by a second control valve (102), that communicates the balance chamber (94) with the low pressure source;

wherein system is configured such the first control valve (98) is open and the second control valve (102) is closed when the engine valve (84/133) is disengaged from the valve seat (22), and the first control valve (98) is closed and the second control valve (102) is open when the engine valve (84/133) is engaged with the valve seat (22).

7. The pressure balancing system of claim 6, wherein the valve piston (82/136) is a piston head (82) configured to engage the valve seat (22).

8. The pressure balancing system of claim 6, wherein the engine valve (84/133) includes a poppet head (134) configured to engage the valve seat (22), and the valve piston (82/136) is a balance piston (136) on the stem (83/135) of the engine valve (84/133), the balance piston (136) configured to be movable in the recess (86).

9. The pressure balancing system of claim 6, wherein the engine valve (84/133) is configured to open outwardly into the passage (24) and away from the cylinder (12).

10. The pressure balancing system of claim 6, wherein the engine (78/128) is a split-cycle engine (78/128), and the passage (24) is the crossover passage (24) of the split-cycle engine (78/128).

11. The pressure balancing system of claim 6, wherein the low pressure source is external ambient pressure.

12. The pressure balancing system of claim 6, further comprising an actuating mechanism (32) configured to actuate the engine valve (84/133).

13. A pressure balancing system for an engine (108/138), comprising:

an engine piston (14) slidably received within a cylinder (12) and operatively connected to a crankshaft;

a engine valve (116/143) including a stem (117/145) and a valve piston (119/144), the engine valve (116/143) operable to engage a valve seat (22) and control fluid communication between a passage (24) and the cylinder (12); and a balance chamber (94) formed by a top (90) of the valve piston (119/144) and a recess (86) connected to and extending from the passage (24), the balance chamber (94) being in fluid communication with the passage (24) and a low pressure source;

a first balance port (118) in the engine (108/138) and a second balance port (120) in the valve piston (119/144) that cooperatively control fluid communication between the passage (24) and the balance chamber (94); and a third balance port (122) in the engine (108/138) that controls communication between the balance chamber (94) and the low pressure source;

wherein the system is configured such that movement of the valve piston (119/144) connects and disconnects the first and second balance ports (118, 120).

14. The pressure balancing system of claim 13, wherein the valve piston (119/144) is a piston head (119) configured to engage the valve seat (22).

15. The pressure balancing system of claim 13, wherein the engine valve (116/143) includes a poppet head (141) configured to engage the valve seat (22), and the valve piston (119/144) is a balance piston (144) on the stem (117/145) of the engine valve (116/143), the balance piston (144) configured to be movable in the recess (86).

16. The pressure balancing system of claim 13, wherein the engine valve (116/143) is configured to open outwardly into the passage (24) and away from the cylinder (12).

17. The pressure balancing system of claim 13, wherein the engine (108/138) is a split-cycle engine (108/138), and the passage (24) is the crossover passage (24) of the split-cycle engine (108/138).

18. The pressure balancing system of claim 13, wherein the low pressure source is external ambient pressure.

19. The pressure balancing system of claim 13, further comprising an actuating mechanism (32/114) configured to actuate the engine valve (116/143).

20. A pressure balancing system for an engine (148), comprising:

an engine piston (14) slidably received within a cylinder (12) and operatively connected to a crankshaft;

an engine valve (155) including a stem (145) and a head (157), the engine valve (155) operable to engage a valve seat (22) and control fluid communication between a passage (24) and the cylinder (12), and the head (157) of the engine valve (155) including an outer face (160) adjacent the cylinder (12);

a balance piston (159) on the stem (145) of the engine valve (155) and movable in a balance chamber (94), the balance chamber (94) formed by an outer face (161) of the balance piston (159) and recess (86) connected to and extending from the passage (24); and a first balance port (152) including a first control valve (154) therein, the first balance port (152) configured to provide fluid communication between the balance chamber (94) and the cylinder (12), thereby substantially balancing pressure on both the outer face (160) of the head (157) of the engine valve (155) and the outer face (161) of the balance piston (159);

wherein the system is configured to close the first control valve (154) during at least a portion of a combustion event in the cylinder (12).

21. The pressure balancing system of claim 20, further comprising:

a second balance port (156) including a second control valve (158) therein, the second balance port (156) configured to provide fluid communication between the passage (24) and the balance chamber (94).

22. The pressure balancing system of claim 21, wherein the system is configured such that the second control valve (158) is closed during an exhaust stroke of the engine piston (14) and during initial opening of the engine valve (155), the second control valve (158) is open at or near top dead center of the engine piston (14) and during an expansion stroke of the engine piston (14), the first control valve (154) is open during the exhaust stroke of the engine piston (14) and during initial opening of the engine valve (155), and the first control valve (154) is closed when the engine valve (155) is fully open and during the expansion stroke of the engine piston (14).

23. The pressure balancing system of claim 20, wherein the engine valve (155) is configured to open outwardly into the passage (24) and away from the cylinder (12).

24. The pressure balancing system of claim 20, wherein the engine (148) is a split-cycle engine (148), and the passage (24) is the crossover passage (24) of the split-cycle engine (148).

25. The pressure balancing system of claim 20, further comprising an actuating mechanism (32/114) configured to actuate the engine valve (155).

* * * * *